US010236149B2

(12) United States Patent
Coles et al.

(10) Patent No.: US 10,236,149 B2
(45) Date of Patent: Mar. 19, 2019

(54) CIRCUIT BREAKER HAVING A FLOATING MOVEABLE CONTACT

(71) Applicant: ABB Schweiz AG, Baden (CH)

(72) Inventors: Derry Robert Coles, Madrid (ES); Pablo Cejudo Benito, Mostoles Madrid (ES); Jaime Sosa Rincon, Mostoles Madrid (ES)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/888,943

(22) PCT Filed: Nov. 5, 2014

(86) PCT No.: PCT/ES2014/070826
§ 371 (c)(1),
(2) Date: Feb. 16, 2017

(87) PCT Pub. No.: WO2016/071539
PCT Pub. Date: May 12, 2016

(65) Prior Publication Data

US 2017/0236670 A1 Aug. 17, 2017

(51) Int. Cl.
*H01H 71/10* (2006.01)
*H01H 71/02* (2006.01)
(Continued)

(52) U.S. Cl.
CPC ..... *H01H 71/0207* (2013.01); *H01H 1/221* (2013.01); *H01H 71/10* (2013.01);
(Continued)

(58) Field of Classification Search
CPC ..... H01H 9/20; H01H 71/505; H01H 71/10; H01H 71/128; H01H 71/526; H01H 13/14; H01H 13/705; H01H 2221/044
(Continued)

(56) References Cited

U.S. PATENT DOCUMENTS 2,759,075 A * 8/1956 Hults ..... H01H 23/065 200/302.3
6,114,641 A * 9/2000 Castonguay ..... H01H 1/205 200/17 R
(Continued)

FOREIGN PATENT DOCUMENTS

CN 102568882 A 7/2012
DE 3619242 A1 12/1987
(Continued)

OTHER PUBLICATIONS

International Search Report and Written Opinion date Jul. 20, 2015 which was issued in connection with PCT Patent Application No. PCT/ES2014/070826 which was filed on Nov. 5, 2014.
(Continued)

*Primary Examiner* — Ahmed Saeed
(74) *Attorney, Agent, or Firm* — Barnes & Thornburg LLP

(57) ABSTRACT

A circuit breaker includes a housing, a fixed contact mounted in the housing, a pivot member arranged in the housing, and a pivoting arm moveably mounted in the housing. The pivoting arm includes a moveable contact. The pivoting arm is rotatable about and translatable relative to the pivot member to selectively engage and disengage the fixed and moveable contacts.

7 Claims, 2 Drawing Sheets

(51) Int. Cl.
*H01H 1/22* (2006.01)
*H01H 71/52* (2006.01)
*H01H 71/24* (2006.01)

(52) U.S. Cl.
CPC ..... *H01H 71/526* (2013.01); *H01H 71/2463* (2013.01); *H01H 2205/002* (2013.01); *H01H 2235/01* (2013.01)

(58) Field of Classification Search
USPC .... 200/50.24, 323, 237, 318, 321, 325, 531, 200/530, 61.76, 252, 536
See application file for complete search history.

(56) References Cited

U.S. PATENT DOCUMENTS

| | | | | |
|---|---|---|---|---|
| 8,686,311 | B2 | 4/2014 | Vigouroux et al. | |
| 2011/0193660 | A1* | 8/2011 | Baek ..... | H01H 1/226 335/15 |

FOREIGN PATENT DOCUMENTS

| | | | |
|---|---|---|---|
| DE | 19919421 | A1 | 12/1987 |
| EP | 0026416 | A1 | 4/1981 |
| WO | 8808614 | A1 | 11/1988 |

OTHER PUBLICATIONS

Chinese Search Report issued in connection with corresponding CN Patent Application No. 201480083219.0 dated May 16, 2018.

* cited by examiner

CIRCUIT BREAKER HAVING A FLOATING MOVEABLE CONTACT

CROSS-REFERENCE TO RELATED APPLICATION

The is application is a U.S. national stage of International Application Serial No. PCT/ES2014/070826, filed Nov. 5, 2014.

BACKGROUND OF THE INVENTION

The subject matter disclosed herein relates to the art of circuit breakers and, more particularly to a circuit breaker having a floating moveable contact.

A circuit breaker includes one or more stationary contacts and one or more moveable contacts that are connected to close a circuit to pass electrical current. In the event that the electrical current exceeds predetermined parameters, such as during a short circuit event, the moveable contact(s) is/are shifted away from the stationary contact(s) to open the circuit.

BRIEF DESCRIPTION OF THE INVENTION

According to one aspect of an exemplary embodiment, a circuit breaker includes a housing, a fixed contact mounted in the housing, a pivot member arranged in the housing, and a pivoting arm moveably mounted in the housing. The pivoting arm includes a moveable contact. The pivoting arm is rotatable about, and translatable relative to, the pivot member to selectively engage and disengage the fixed and moveable contacts.

According to another aspect of an exemplary embodiment, a pivoting arm for a circuit breaker includes a body including a first end, a second end, and an intermediate portion, and a slot formed in the intermediate portion. The slot is defined by a wall portion. The pivoting arm is rotatable about, and translatable relative to, a pivot member.

According to yet another aspect of an exemplary embodiment, a method of shifting a pivoting arm of a circuit breaker includes pivoting the pivoting arm about a pivot member between an open position and a closed position, and translating the pivoting arm relative to the pivot member.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
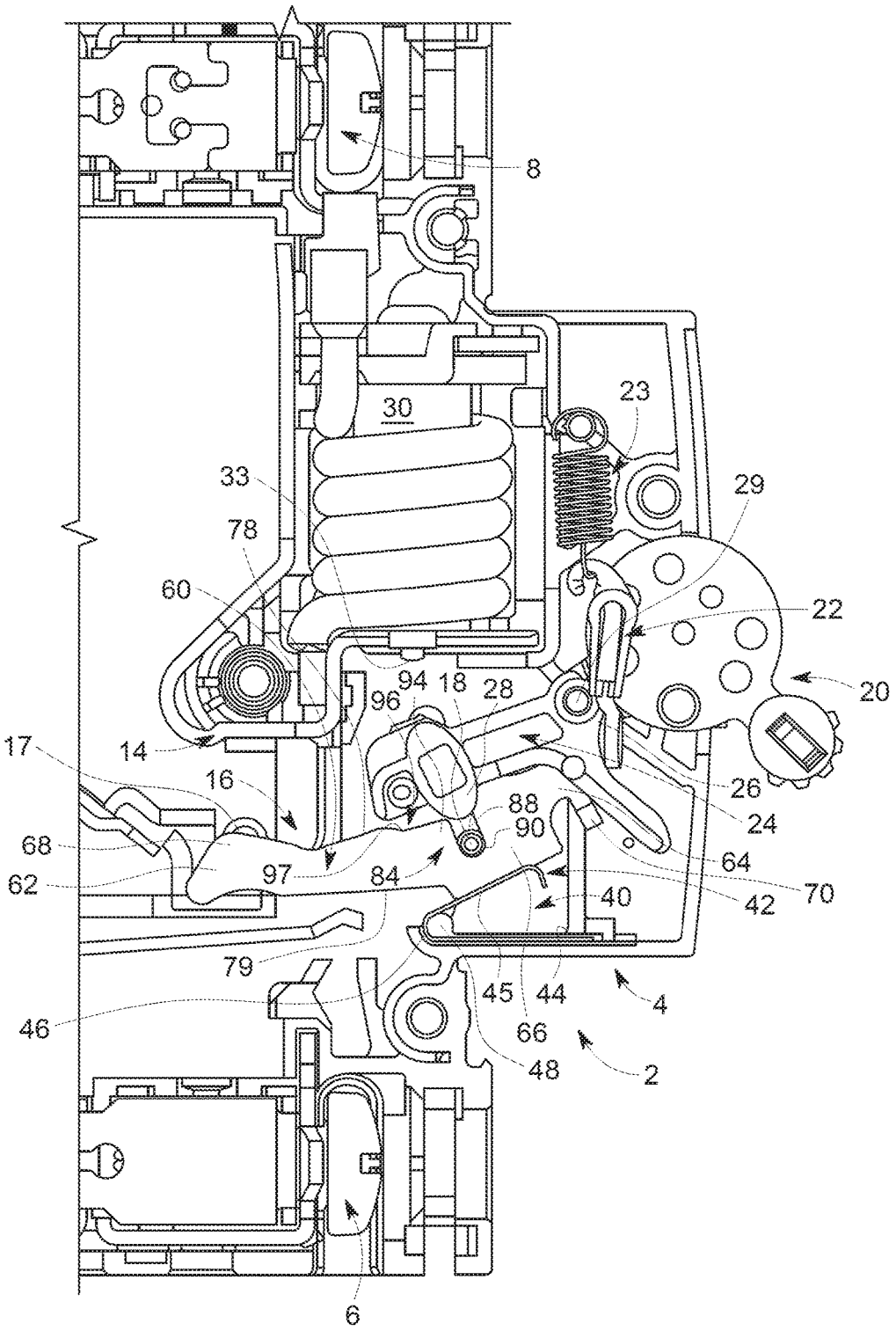
FIG. 1 is a partial cross-sectional view of a circuit breaker, in accordance with an exemplary embodiment, shown in an open configuration.

A circuit breaker, in accordance with an exemplary embodiment, is indicated generally at 2, in FIG. 1. Circuit breaker 2 includes a housing 4 that supports a first or line connector 6 and a second or load connector 8. Of course, it should be understood that the relative location of the line connector and the load connector may vary. It should also be understood that connections, e.g., line connections and load connections, may vary depending upon installation, preference, and custom. Specifically, line connector 6 may receive a load connection, and load connector 8 may receive a line connection.

Figure 2:
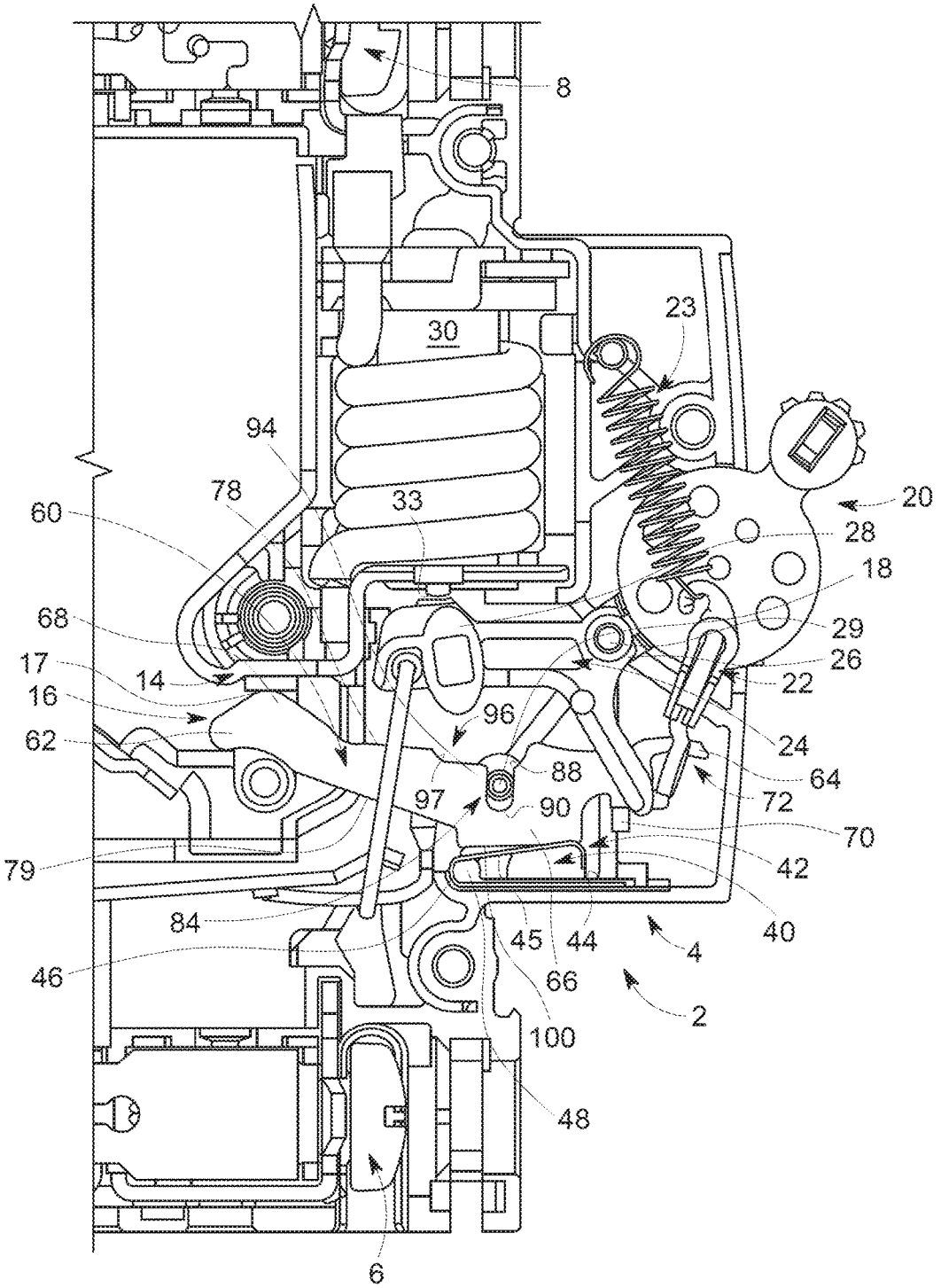
FIG. 2 is a partial cross-sectional view of a circuit breaker, in accordance with an exemplary embodiment, shown in a closed configuration.

Circuit breaker 2 includes a first or stationary contact 14 which, in the exemplary embodiment shown, is electrically connected to load connector 8. Circuit breaker 2 also includes a second or pivoting arm 16 provided with a contact 17 electrically connected to line connector 6. As will be detailed more fully below, pivoting arm 16 may pivot and translate about a pivot member 18 between an open configuration (FIG. 1) and a closed configuration (FIG. 2). More specifically, pivot member 18 establishes a rotational axis (not separately labeled) for pivoting arm 16. More specifically, circuit breaker 2 includes a toggle 20 that may cause pivoting arm 16 to connect with, and disconnect from, stationary contact 14 through a clip 22 coupled to a spring 23. Circuit breaker 2 also includes a de-activation member 24. De-activation member 24 extends from a first end portion 26, to a second end portion 28 that acts upon pivoting arm 16. As will be discussed more fully below, de-activation member 24 pivots about a pin 29 to shift pivoting arm 16 away from stationary contact 14. More specifically, in the event of an over-current condition, a solenoid 30 is activated causing a plunger 33 to extend outward and contact de-activation member 24 which, in turn, engages with and causes pivoting arm 16 to move away from stationary contact 14 opening an electrical circuit.

In further accordance with an exemplary embodiment, a biasing member 40, shown in the form of a flat spring 42, urges pivoting arm 16 into contact with stationary contact 14, as will be detailed below. Biasing member 40 includes a first leg 44 that extends to a second leg 45 through a bend or curved portion 46 that wraps about a fulcrum member 48. First leg 44 abuts an inner surface (not separately labeled) of housing 4 while second leg 45 engages with pivoting arm 16. Specifically, a biasing force created in second leg 45 via fulcrum member 48 acts upon pivoting arm 16, as will be detailed more fully below. Specifically, biasing member 40 provides at least two benefits to the exemplary embodiment. Biasing member 40 advantageously urges pivoting arm 16 toward pivot member 18 and also provides a force that maintains contact between pivoting arm 16 and stationary contact 14.

In accordance with an aspect of an exemplary embodiment, pivoting arm 16 includes a body 60 having a first end 62, a second end 64 (FIG. 2) and an intermediate portion 66. Contact 17 is provided at first end 62. Contact 17 selectively engages with stationary contact 14. Second end 64 includes a trip member 70 and a manual activation/de-activation element 72. Trip member 70 extends generally, perpendicularly outwardly from body 60 and provides an interface with a trip mechanism (not shown) that reacts to an input which may be provided from a bi-metallic strip (also not shown). Trip member 70 is acted upon by the trip mechanism to move pivoting arm 16 away from stationary contact 14 in the event of, for example, an over-current condition. Manual activation/de-activation element 72 cooperates with clip 22 and toggle 20. In this manner, toggle 20 may be manipulated to manually shift pivoting arm 16 between an open configuration (FIG. 1) and a closed configuration (FIG. 2). Pivoting arm 16 also includes a first outer edge 78 and a second outer edge 79 that extend between first and second ends 62 and 64 on opposing sides of intermediate potion 66.

In further accordance with an exemplary embodiment, pivoting arm 16 includes a slot 84 formed in intermediate portion 66. Slot 84 is defined by a wall portion 88 that includes a first or curvilinear end section 90 and a second end section 94 open at first outer edge 78. Slot 84 operably receives pivot member 18 and not only allows for rotation, but also translation of pivoting arm 16. Slot 84 establishes an opening or discontinuity in outer edge 78 of pivoting arm 16.

Pivoting arm 16 also includes a de-activation surface 96 that may take the form of a recess 97 formed in first outer edge 78 at slot 84, and a biasing member contact surface 100 provided at second outer edge 79.

In accordance with an exemplary embodiment, de-activation member 24 engages with de-activation surface 96 to unseat pivoting arm 16 from stationary contact 14 against a force applied to biasing member contact surface 100 by second leg 45 of flat spring 42. Of course, it should be understood that pivoting arm 16 may also be shifted through operation of toggle 20. Toggle 20, acts upon activation/de-activation element 72 through clip 22 to rotate pivoting arm 16 away from stationary contact 14 against the force applied to biasing member contact surface 100. In this position, electrical current may not flow between line connector 6 and load connector 8. Pivoting arm 16 may also shift to a closed configuration, through rotation of toggle 20, in which first end 62 engages with stationary contact 14 allowing electrical current to flow between line connector 6 and load connector 8.

In yet still further accordance with an exemplary embodiment, when in a closed configuration as shown in FIG. 2, curvilinear end section 90 is spaced from pivot member 18. Over time, first end 62 may wear as a result of connecting and breaking a flow of electrical current. As wear occurs, pivoting arm 16 may translate further toward stationary contact 14. Specifically, curvilinear end section 90 of slot 84 may move toward pivot member 18 under an influence of the force applied by flat spring 42. Translation may occur over time and until such a time as curvilinear end section 90 rests upon pivot member 18. In this manner, circuit breaker 2 may continue to operate despite changes in surface characteristics of first end 62 and/or stationary contact 14.

At this point it should be understood that the exemplary embodiments describe a circuit breaker having a pivoting arm that both rotates about, and translates relative to, a pivot member. The pivoting arm includes a slot that facilitates the translation to accommodate wear in a contact surface(s). A benefit of the present invention lies in the incorporation of a biasing member, which may take the form of a flat spring, that urges the pivoting arm toward the pivot member and also provides a force that maintains contact between pivoting arm and a stationary contact. It should also be understood that the exemplary embodiments provide a system that allows the pivoting arm to adjust for tip wear/erosion and maintain a desired contact pressure over an overall, extended, service life of the circuit breaker. Further, the pivoting arm coupled with the biasing member, in accordance with the exemplary embodiments, ensures continued contact pressure while also achieving a reduction in parts, a simplification in an overall construction, and a reduction/elimination in potential failure points.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A circuit breaker comprising:

a housing;

a fixed contact mounted in the housing;

a pivoting contact arm comprising a body mounted in the housing having a first end and an opposing second end, and a biasing member contact surface, the pivoting contact arm supporting a moveable contact at the first end, and selectively rotatable to engage and disengage the fixed and movable contacts, the pivoting contact arm body defining a slot formed therein between the first and second ends, the slot defining a first closed end section and an opposing second open end section;

a pivot member disposed in the slot, wherein the pivoting contact arm is rotatable about and translatable relative to the pivot member; and a spring having a first leg mounted to the housing and a second leg abutting the biasing member contact surface of the pivoting contact arm.

2. The circuit breaker according to claim 1, wherein the pivot member is spaced from the first closed end section when the fixed and moveable contacts are disengaged.

3. The circuit breaker according to claim 1, wherein the pivoting contact arm includes a trip member arranged at the second end, the trip member extending substantially perpendicularly outwardly of the pivoting contact arm along an axis parallel to a rotational axis defined by the pivot member.

4. The circuit breaker according to claim 1, wherein the biasing member contact surface is substantially adjacent to the slot.

5. The circuit breaker according to claim 1, wherein the housing includes a fulcrum member, the spring extending about the fulcrum member.

6. The circuit breaker according to claim 1, wherein the pivoting contact arm includes a de-activation surface formed opposite the biasing member contact surface and a manual activation/de-activation element provided at the second end.

7. The circuit breaker according to claim 6, wherein the de-activation surface defines a recess formed in an outer edge of the pivoting contact arm, the recess extending toward the slot.

* * * * *